US010519701B2

(12) United States Patent
Patterson et al.

(10) Patent No.: US 10,519,701 B2
(45) Date of Patent: Dec. 31, 2019

(54) VEHICLE DOOR CHECK MECHANISM

(71) Applicant: FORD GLOBAL TECHNOLOGIES, LLC, Dearborn, MI (US)

(72) Inventors: Ian Patterson, Billericay (GB); Brian Westgarth, Billericay (GB); Rob Swann, Rayleigh (GB); Jack Whitehurst, Leigh on Sea (GB); John Strudwick, Rheinbach (DE)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 16/154,220

(22) Filed: Oct. 8, 2018

(65) Prior Publication Data

US 2019/0106917 A1 Apr. 11, 2019

(30) Foreign Application Priority Data

Oct. 9, 2017 (GB) ..... 1716496.3

(51) Int. Cl.

*E05C 17/22* (2006.01)
*E05C 17/20* (2006.01)
*E05F 5/02* (2006.01)

(52) U.S. Cl.

CPC ..... *E05C 17/206* (2013.01); *E05F 5/025* (2013.01); *E05Y 2900/531* (2013.01)

(58) Field of Classification Search

CPC ... Y10T 16/61; Y10T 16/629; Y10T 16/6295; Y10T 292/285; Y10T 292/286; Y10T 292/304; E05C 17/025; E05C 17/04; E05C 17/12; E05C 17/20; E05C 17/203; E05C 17/206; E05C 17/22; E05C 17/26; E05C 17/24; E05C 17/28; E05C 17/18; E05F 5/025; E05F 5/08; F05F 5/06; F05F 5/08; F05F 5/12; E05Y 2900/531

See application file for complete search history.

(56) References Cited

U.S. PATENT DOCUMENTS 3,082,028 A * 3/1963 Werle ..... E05B 13/001 292/1
3,553,764 A * 1/1971 Gaines, Jr. ..... E05F 3/04 16/84
5,474,344 A * 12/1995 Lee ..... E05C 17/203 16/86 C
5,727,287 A * 3/1998 Hosken ..... E05C 17/203 16/334
6,446,305 B1 9/2002 Kneeland
6,813,811 B2 11/2004 Matsuki et al.
6,901,630 B2 * 6/2005 Liang ..... E05C 17/203 16/82
7,143,473 B2 12/2006 Matsuki (Continued)

FOREIGN PATENT DOCUMENTS

JP 08100558 A * 4/1996
JP 2982560 B2 * 11/1999
JP 2016102304 A * 6/2016

*Primary Examiner* — Chuck Y Mah

(74) *Attorney, Agent, or Firm* — Jason Rogers; Vichit Chea; King & Schickli, PLLC

(57) ABSTRACT

A vehicle door check mechanism includes a bellows to act as a pneumatic retarder to prevent a high load from being transferred from the door check mechanism to a structural part of a door of the motor vehicle if that door is opened to a fully open position at high speed.

13 Claims, 4 Drawing Sheets

(56) References Cited

U.S. PATENT DOCUMENTS

| | | | | |
|---|---|---|---|---|
| 2004/0111832 | A1* | 6/2004 | Murayama | E05C 17/203 16/82 |
| 2006/0150367 | A1 | 7/2006 | Matsuki | |
| 2006/0180964 | A1* | 8/2006 | Siemer | E05F 5/022 267/140 |
| 2006/0267353 | A1* | 11/2006 | Van Den Heuvel | E05C 17/203 292/262 |
| 2007/0012687 | A1 | 1/2007 | Lowen et al. | |
| 2007/0040392 | A1* | 2/2007 | Matsuki | E05C 17/206 292/262 |
| 2008/0066260 | A1* | 3/2008 | Clark | E05C 17/203 16/86 A |
| 2009/0072552 | A1* | 3/2009 | Kitayama | E05C 17/203 292/262 |
| 2009/0106934 | A1 | 4/2009 | Chang et al. | |
| 2009/0211056 | A1 | 8/2009 | Tashima et al. | |
| 2011/0016665 | A1* | 1/2011 | Ng | E05C 17/203 16/85 |
| 2014/0059802 | A1 | 3/2014 | Matsuki | |
| 2016/0024828 | A1 | 1/2016 | Murayama et al. | |

* cited by examiner

VEHICLE DOOR CHECK MECHANISM

TECHNICAL FIELD

This document relates to motor vehicles and in particular to a mechanism for checking the movement of a door of a motor vehicle.

BACKGROUND

It is well known from, for example, U.S. Pat. No. 7,143,473 to provide a door check mechanism for limiting the opening motion of a vehicle door that also provides a number of intermediate stay positions.

It is a problem with such a door check mechanism that if the door is swung open rapidly due either to driver action or due to a gust of wind catching the door then damage can occur to the door check mechanism and/or the door structure to which the door check mechanism is mounted when an end stop of the mechanism rapidly impacts against an abutment member of the mechanism.

SUMMARY

It is an object of this document to provide a vehicle door check mechanism that overcomes the aforesaid problem thereby minimising the risk of damage occurring to the door check mechanism or to the structure of the vehicle door.

According to a first aspect, there is provided a vehicle door check mechanism comprising a door holder bar having an end stop at one end thereof and being adapted at an opposite end by means of a transverse aperture in the door holder bar for attachment to part of a body structure of a motor vehicle. A support housing is fastened, within a door cavity of a door of the motor vehicle, to a structural part of the respective door. The support housing has a passage through which the door holder bar extends. The door check mechanism further comprises a pneumatic retarder in the form of a bellows located on the door holder bar. The bellows has at least one vent. The bellows is located between the end stop and the support housing and is compressed between the end stop and the support housing when the door approaches a fully open position so as to force air out through the at least one vent in a restricted manner thereby retarding the motion of the door towards the fully open position.

The bellows may be sealingly attached at one end to the door holder bar and sealingly engage the door holder bar at an opposite end. The at least one vent may comprise one or more apertures formed in a wall of the bellows.

Alternatively, the bellows may co-operate at both ends with the door holder bar so as to form respective interfaces between the ends of the bellows and the door holder bar. The interfaces may form vents that allow air to escape between the door holder bar and the ends of the bellows in the restricted manner when the bellows is compressed.

As yet another alternative, the bellows may co-operate at one end with the door holder bar so as to form an interface between the respective end of the bellows and the door holder bar and may be sealingly attached at an opposite end to the door holder bar. The interface between the one end of the bellows and the door holder bar may form the at least one vent that allows air to escape between the door holder bar and the respective end of the bellows in the restricted manner when the bellows is compressed.

As a further alternative, the bellows may be sealingly attached at both ends to the door holder bar. The bellows may include one or more apertures formed in a wall of the bellows that form the at least one vent that allows air to escape in the restricted manner from the bellows when the bellows is compressed.

The door holder bar may include a number of spaced apart recesses for co-operation with a door holding mechanism forming part of the vehicle door check mechanism and being disposed in the support housing so as to provide intermediate holding positions for the door between the fully open position and a fully closed position.

The door holding mechanism may further comprise at least one locking member. Each locking member may be biased by a respective spring towards the door holder bar so as to engage with the one of the spaced apart recesses in the door holder bar when the door is in a predefined partially open position.

The end stop may comprise an enlarged portion of the door holder bar. Alternatively, the end stop may comprise an enlarged portion of the door holder bar, a resilient pad and a support plate interposed between the enlarged portion and the resilient pad.

The door holder bar may be adapted for attachment to part of a body structure of a motor vehicle by means of a transverse aperture formed in the door holder bar for accommodating a mounting pin.

According to a second aspect, there is provided a motor vehicle having: (a) a door pivotally mounted to part of the body structure of the motor vehicle for movement between fully open and fully closed positions and (b) a vehicle door check mechanism constructed to prevent movement of the door in an opening direction beyond a predefined limit.

The door may have a door structure defining a cavity and the support housing may be fastened within the door cavity to a structural part of the door defining a front end of the door cavity.

BRIEF DESCRIPTION OF THE DRAWING FIGURES

The vehicle door check mechanism and the motor vehicle incorporating the same will now be described by way of example with reference to the accompanying drawing of which:

DETAILED DESCRIPTION

Figure 1:
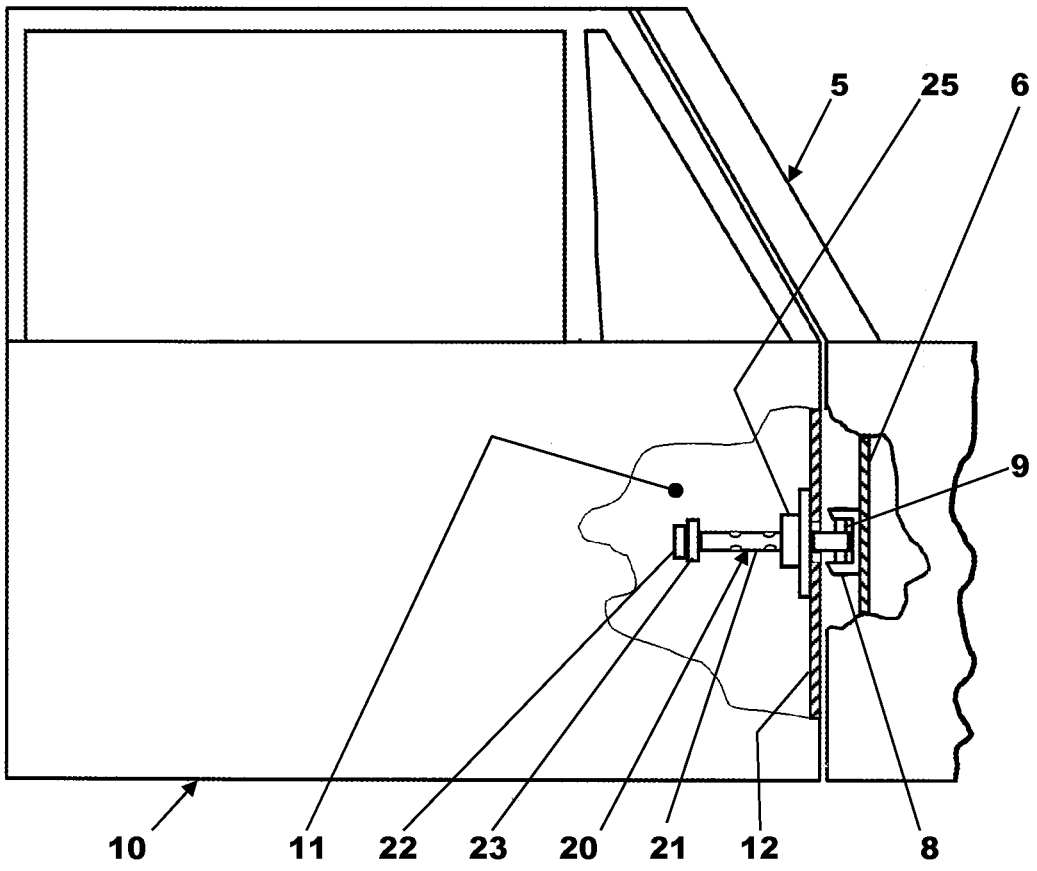
PRIOR ART Fig.1
FIG. 1 is a partially cutaway side view of a motor vehicle door having a prior art door check mechanism showing the door in a closed position.
Figure 2:
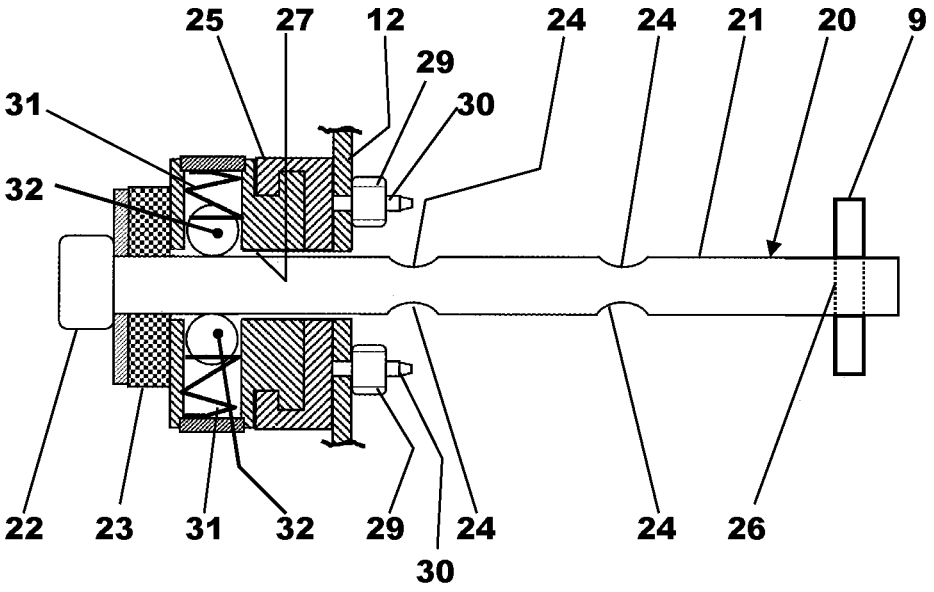
PRIOR ART Fig.2
FIG. 2 is an enlarged cross-sectioned view of the prior art door check mechanism shown in FIG. 1 showing the arrangement of the door check mechanism when the door is fully open.

With reference to FIGS. 1 and 2 there is shown a prior art motor vehicle 5 having a door 10 pivotally mounted to part of a body structure 6 of the motor vehicle 5 for movement between fully open and fully closed positions and a vehicle door check mechanism 20 to prevent movement of the door 10 in an opening direction beyond a predefined limit referred to as a 'fully open position'.

The door 10 has a door structure defining a cavity 11 in which the vehicle door check mechanism 20 is mounted to a structural part 12 of the door 10 defining a front end of the door cavity 11.

The vehicle door check mechanism 20 comprises a door holder bar 21 having an end stop 22 at one end thereof and being adapted at an opposite end for attachment to part of a body structure of a motor vehicle by means of a transverse receiver or transverse aperture 26 formed in the door holder bar 21 for accommodating a mounting pin 9. The mounting pin 9 is engaged with a bracket 8 fastened to part of the body structure 6 of the motor vehicle 5.

The support housing 25 has a passage 27 through which the door holder bar 21 extends.

The door holder bar 21 is, in the case of this example, rectangular in cross-section and has four spaced apart recesses 24 for co-operation with a door holding mechanism disposed in the support housing 25 so as to provide intermediate holding positions for the door 10 between the fully open and fully closed positions.

The door holding mechanism comprises a pair of locking members in the form of balls 32 each being biased by a respective spring 31 towards the door holder bar 21 so as to engage with the one of the recesses 24 in the door holder bar 21 when the door 10 is in a predefined partially open position.

The end stop 22 comprises an enlarged portion of the door holder bar 21 and a resilient pad 23 having a support plate that abuts against the end stop 22.

When the door 10 reaches a position approaching the fully open position the resilient pad 23 contacts the support housing 25 and is compressed by the movement of the end stop 22 towards the support housing 25.

If the door 10 is opened quickly the kinetic energy of the opening door 10 must be arrested by compression of the resilient pad 23 as the door reaches the fully open position and this results in a large force being transferred via the support housing 25 to the door structure 12 to which the support housing 25 is secured via a threaded connection in the form of nuts 29 and threaded studs 30.

Figure 3:
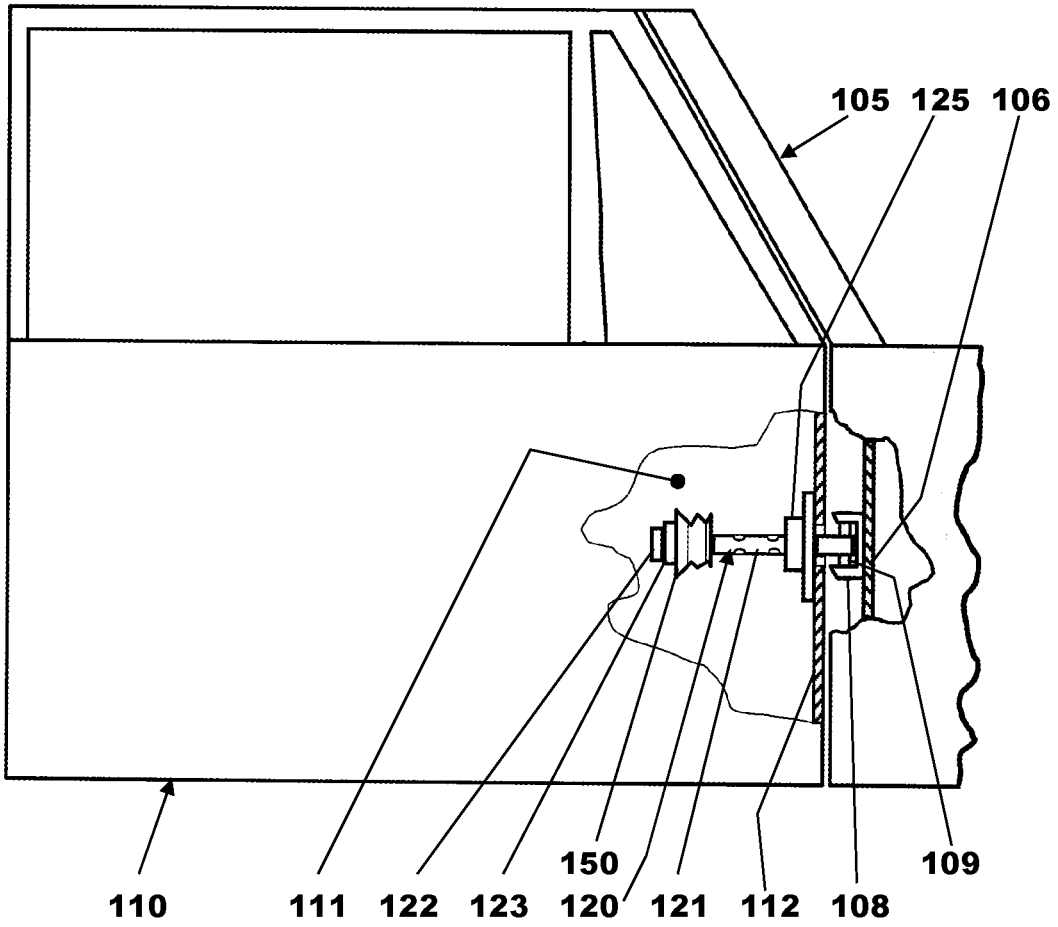
FIG. 3 is a partially cutaway side view of a motor vehicle door having a new and improved, door check mechanism showing the door in a closed position.
Figure 4:
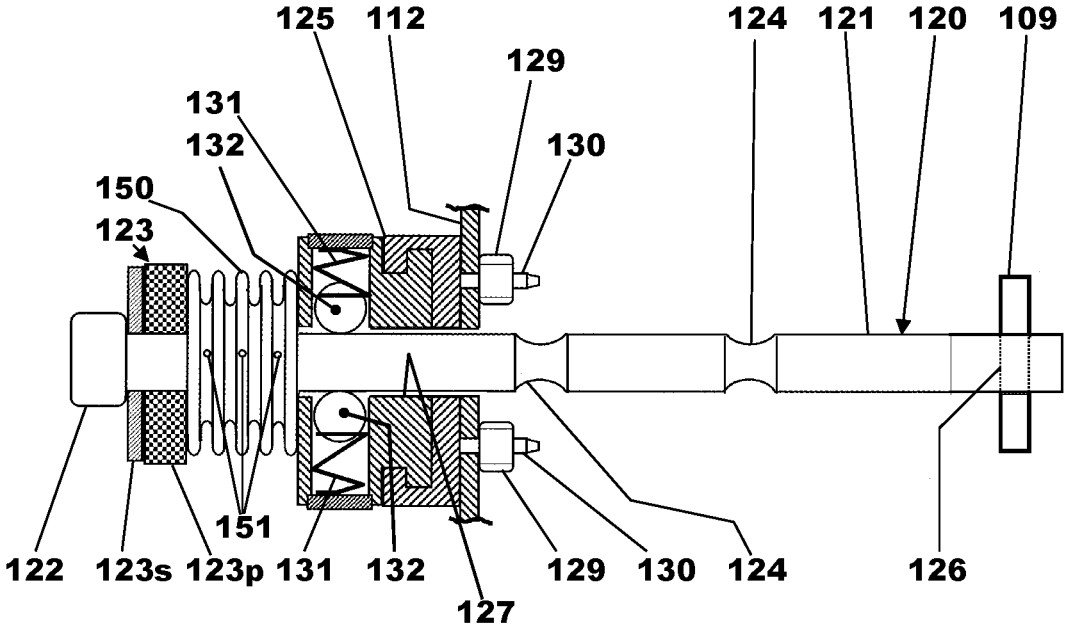
FIG. 4 is an enlarged cross-sectioned view of the new and improved door check mechanism shown in FIG. 3 showing the arrangement of the door check mechanism when the door is approaching a fully open position.

With reference to FIGS. 3 and 4 there is shown a motor vehicle 105 in accordance with this invention having a door 110 pivotally mounted to part of a body structure 106 of the motor vehicle 105 for movement between fully open and fully closed positions and a vehicle door check mechanism 120 to prevent movement of the door 110 in an opening direction beyond a predefined limit referred to as a fully open position.

The door 110 has a door structure defining a cavity 111 in which the vehicle door check mechanism 120 is mounted to a structural part 112 of the door 110 defining a front end of the door cavity 111.

The vehicle door check mechanism 120 comprises a door holder bar 121 having an end stop 122 at one end thereof and being adapted at an opposite end for attachment to part of the body structure 106 of the motor vehicle 105 by means of a transverse aperture 126 formed in the door holder bar 121 for accommodating a mounting pin 109. The mounting pin 109 is engaged with a bracket 108 fastened to part of the body structure 106 of the motor vehicle 105.

The vehicle door check mechanism 120 further comprises a support housing 125 fastened within the door cavity 111 and having a passage 127 through which the door holder bar 121 extends and which guides sliding motion of the door holder bar 121.

The door holder bar 121 is, in the case of this example, circular in cross-section but other cross-sectional shapes could be used. The door holder bar 121 has two spaced apart circumferentially extending recesses 124 for co-operation with a door holding mechanism disposed in the support housing 125 so as to provide intermediate holding positions for the door 110 between fully open and fully closed positions.

In the case of this example, the door holding mechanism comprises a pair of locking members in the form of balls 132 each of the balls 132 being biased by a respective spring 131 towards the door holder bar 121 so as to engage with one of the two recesses 124 in the door holder bar 121 when the door 110 is in a predefined partially open position.

The support housing 125 is secured to the structural part 112 of the door 110 via a threaded connection in the form of nuts 129 engaged with threaded studs 130 that are fastened to and extend from the support housing 125.

In the case of this example, the end stop 122 comprises an enlarged portion of the door holder bar 121 and a resilient abutment 123 comprised of a resilient pad 123*p* and a support plate 123*s* that abuts against the end stop 122.

A pneumatic retarder in the form of a bellows 150 is located on the door holder bar 121 between the end stop 122 and the support housing 125.

The bellows 150 is compressed between the end stop 122 and the support housing 125 when the door 110 approaches a fully open position so as to retard the motion of the door 110 towards the fully open position.

In the case of this example, the bellows 150 has in a wall thereof a number of small diameter apertures 151 forming vents to allow air to escape in a restricted flow manner from the bellows 150 when the bellows 150 is compressed. The total area of the apertures 151 is such that the flow of air out of the bellows 150 as it is compresses is restricted thereby providing a retarding effect to the opening of the door 110 to its fully open position.

The bellows 150 is sealingly attached at a first or one end to the door holder bar 121 where the bellows 150 interacts with the support housing 125 and sealingly engages the door holder bar 121 at a second or opposite end where the bellows interacts with the resilient pad 123*p* so that a seal is formed between the bellows 150 and the resilient pad 123*p* when the bellows 150 is compressed.

When the door 110 reaches a position approaching the fully open position the bellows 150 contacts the resilient pad 123*p* and is compressed by the movement of the end stop 122 towards the support housing 125. As the bellows is compressed air is expelled via the apertures 151 but in a restricted manner so that pressure will be built up within the bellows 150 acting to retard the opening motion of the door 110. Eventually, the bellows 150 will be fully compressed by the opening motion of the door 110 and any remaining kinetic energy will be transferred into the resilient pad 123*p*. However, it will be appreciated that, due to the retarding effect of the bellows 150, the force transferred from the resilient pad 123*p* through the fully compressed bellows 150 to the support housing 125 is considerably reduced thereby reducing the risk of damage occurring to the support housing 125 and to the structural part 112 of the door 110 or the resilient pad 123*p*.

As an alternative to the above, the bellows 150 can be sealingly attached to the door holder bar 121 where the bellows 150 interacts with the resilient pad 123*p* and sealingly engage the door holder bar 121 at an opposite end where the bellows interacts with the support housing 125.

With such an arrangement, when the door 110 reaches a position approaching the fully open position, the bellows 150 will contact the support housing 125 and will be compressed by the movement of the end stop 122 towards the support housing 125. As the bellows 150 is compressed, air will be expelled as previously described, via the apertures 151 in the bellows 150 but in a restricted manner so that pressure will be built up within the bellows 150 acting to retard the opening motion of the door 110.

Eventually the bellows 150 will be fully compressed by the opening motion of the door 110 and any remaining kinetic energy will be transferred into the resilient pad 123*p*. As before, due to the retarding effect of the bellows 150, the force transferred to the support housing 125 is considerably reduced thereby reducing the risk of damage occurring to the support housing 125, the structural part 112 of the door 110 or the resilient pad 123*p*.

It will be appreciated that alternative bellows arrangements can be used, for example, the bellows 150 could co-operate at both ends with the door holder bar 121 so as to form respective interfaces between the ends of the bellows 150 and the door holder bar 121. In such a case, the interfaces between the ends of the bellows 150 and the door holder bar 121 act as vents that allow air to escape in a restricted flow manner from the bellows 150 when the bellows 150 is compressed. With such an arrangement there is no need for apertures in the bellows 150 although apertures could also be provided if required.

As yet another example, the bellows 150 can be (a) arranged to co-operate at one end with the door holder bar 121 so as to form an interface between the respective end of the bellows 150 and the door holder bar 121 and (b) sealingly attached at an opposite end to the door holder bar 121. In such a case, the interface between the one end of the bellows 150 and the door holder bar 121 acts as a vent that allows air to escape in a flow restricted manner from the bellows 150 when the bellows 150 is compressed and so there is no need for apertures in the bellows 150 although apertures could also be provided.

As yet one further example, the bellows can be sealingly attached at both ends to the door holder bar. The bellows has a wall that includes one or more apertures formed therein. The apertures form vents that allow air to escape in a restricted manner from the bellows when the bellows is compressed.

It will also be appreciated that the bellows could have a resilient pad formed as an integral part thereof so that the bellows could react directly against the enlarged portion of the door holder bar.

It will be further appreciated that the integral enlarged portion of the door holding bar could be replaced by a separate end stop member fastened to the end of the door holder bar.

Therefore in summary, a vehicle door check mechanism is disclosed in which a pneumatic retarder is used to slow the opening of a door as it approaches a fully open position in order to reduce the risk of damage.

Although in the described embodiments the pneumatic retarder is in the form of a bellows that is engaged with a door holder bar and is arranged to be pressurised when the door approaches a fully open position other arrangements such as a piston and cylinder could be used in which air is compressed to act as a retarder.

The term 'to allow air to escape in a restricted manner from the bellows when the bellows is compressed' means that the air flow path out of the bellows is sized such that pressure will build up significantly in the bellows when it is compressed.

It will be appreciated by those skilled in the art that although the invention has been described by way of example with reference to one or more embodiments it is not limited to the disclosed embodiments and that one or more alternative embodiments could be constructed without departing from the scope of the invention as defined by the appended claims.

What is claimed:

1. A vehicle door check mechanism comprising:

a door holder bar having an end stop at one end thereof and being adapted at an opposite end by a transverse receiver in the door holder bar for attachment to part of a body structure of a motor vehicle;

a support housing fastened within a door cavity of a door of the motor vehicle to a structural part of the respective door and having a passage through which the door holder bar extends; and a pneumatic retarder in a form of a bellows located on the door holder bar having at least one vent, the bellows being located between the end stop and the support housing and being compressed between the end stop and the support housing when the door approaches a fully open position so as to force air out through the at least one vent in a restricted manner thereby retarding motion of the door towards the fully open position.

2. The vehicle door check mechanism as claimed in claim 1 wherein the bellows is sealingly attached at a first end to the door holder bar and sealingly engages the door holder bar at a second end.

3. The vehicle door check mechanism as claimed in claim 2 wherein the at least one vent comprises one or more apertures formed in a wall of the bellows.

4. The vehicle door check mechanism as claimed in claim 1 wherein the bellows co-operates at both ends with the door holder bar so as to form respective interfaces between the ends of the bellows and the door holder bar and the respective interfaces form vents that allow air to escape between the door holder bar and the ends of the bellows in the restricted manner when the bellows is compressed.

5. The vehicle door check mechanism as claimed in claim 1 wherein the bellows co-operates at a first end with the door holder bar so as to form an interface between the respective end of the bellows and the door holder bar and is sealingly attached at a second end to the door holder bar and the interface between the first end of the bellows and the door holder bar forms the at least one vent that allows air to escape between the door holder bar and the respective end of the bellows in the restricted manner when the bellows is compressed.

6. The vehicle door check mechanism as claimed in claim 1 wherein the bellows is sealingly attached at both ends to the door holder bar and the bellows includes one or more apertures formed in a wall of the bellows that form the at least one vent that allows air to escape in the restricted manner from the bellows when the bellows is compressed.

7. The vehicle door check mechanism as claimed in claim 6 wherein the door holder bar includes a number of spaced apart recesses for co-operation with a door holding mechanism forming part of the vehicle door check mechanism and being disposed in the support housing so as to provide intermediate holding positions for the door between the fully open position and a fully closed position.

8. The vehicle door check mechanism as claimed in claim 7 wherein the door holding mechanism further comprises at least one locking member, each locking member of said at least one locking member being biased by a respective spring towards the door holder bar so as to engage with one of the number of spaced apart recesses in the door holder bar when the door is in a predefined partially open position.

9. The vehicle door check mechanism as claimed in claim 8 wherein the end stop comprises an enlarged portion of the door holder bar.

10. The vehicle door check mechanism as claimed in claim 8 wherein the end stop comprises an enlarged portion of the door holder bar, a resilient pad and a support plate interposed between the enlarged portion and the resilient pad.

11. The vehicle door check mechanism as claimed in claim 10 wherein the door holder bar is adapted for attachment to part of the body structure of the motor vehicle by means of the transverse receiver formed in the door holder bar for accommodating a mounting pin.

12. A motor vehicle having a door pivotally mounted to part of the body structure of the motor vehicle for movement between fully open and fully closed positions and a vehicle door check mechanism as claimed in claim 1 to prevent movement of the door in an opening direction beyond a predefined limit.

13. The motor vehicle as claimed in claim 12 wherein the door has a door structure defining a cavity and the support housing is fastened within the door cavity to a structural part of the door defining a front end of the door cavity.

* * * * *